US010096414B2

(12) United States Patent
Park et al.

(10) Patent No.: US 10,096,414 B2
(45) Date of Patent: Oct. 9, 2018

(54) NON-ORIENTED ELECTRICAL STEEL SHEET AND METHOD OF MANUFACTURING THE SAME

(71) Applicant: POSCO, Gyeongsangbuk-do (KR)

(72) Inventors: Junesoo Park, Gyeongsangbuk-do (KR); Byung-Keun Bae, Gyeongsangbuk-do (KR); Yong-Soo Kim, Gyeongsangbuk-do (KR); Su-Yong Sin, Gyeongsangbuk-do (KR)

(73) Assignee: POSCO, Gyeongsangbuk-Do (KR)

( * ) Notice: Subject to any disclaimer, the term of this patent is extended or adjusted under 35 U.S.C. 154(b) by 580 days.

(21) Appl. No.: 14/368,651

(22) PCT Filed: Dec. 28, 2012

(86) PCT No.: PCT/KR2012/011732
§ 371 (c)(1),
(2) Date: Jun. 25, 2014

(87) PCT Pub. No.: WO2013/100698
PCT Pub. Date: Apr. 7, 2013

(65) Prior Publication Data

US 2015/0000793 A1 Jan. 1, 2015

(30) Foreign Application Priority Data

Dec. 28, 2011 (KR) ..... 10-2011-0145175
Dec. 28, 2011 (KR) ..... 10-2011-0145305

(51) Int. Cl.

| | |
|---|---|
| ***H01F 1/16*** | (2006.01) |
| ***H01F 1/147*** | (2006.01) |
| ***C22C 38/00*** | (2006.01) |
| ***C22C 38/60*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C21D 8/12*** | (2006.01) |

(52) U.S. Cl.
CPC ..... *H01F 1/14775* (2013.01); *C21D 8/1233* (2013.01); *C21D 8/1261* (2013.01); *C22C 38/00* (2013.01); *C22C 38/001* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/14* (2013.01); *C22C 38/60* (2013.01); *H01F 1/16* (2013.01)

(58) Field of Classification Search
CPC ..... C22C 38/02; C22C 38/06; H01F 1/14775
USPC ..... 148/111
See application file for complete search history.

(56) References Cited

U.S. PATENT DOCUMENTS 6,139,650 A * 10/2000 Oda ..... C22C 38/02 148/111
6,531,001 B2 3/2003 Hayakawa et al.

FOREIGN PATENT DOCUMENTS

| | | | |
|---|---|---|---|
| EP | 1 411 138 | A1 | 4/2004 |
| JP | 55-158252 | | 12/1980 |
| JP | 59-100217 | | 6/1984 |
| JP | 62-180014 | | 8/1987 |
| JP | 9-125144 | | 5/1997 |
| JP | H10-298722 | A | 11/1998 |
| JP | 11-61359 | | 3/1999 |
| JP | 11-172384 | | 6/1999 |
| JP | 11-189850 | | 7/1999 |
| JP | 2000-104144 | A | 4/2000 |
| JP | 2000-160306 | | 6/2000 |
| JP | 2001-247943 | A | 9/2001 |
| JP | 2001-303211 | A | 10/2001 |
| JP | 2004-218082 | A | 8/2004 |
| JP | 2005-113185 | | 4/2005 |
| JP | 2005-336503 | A | 12/2005 |
| JP | 2006-124800 | | 5/2006 |
| JP | 2010-248559 | | 11/2010 |
| JP | 4681689 | | 5/2011 |
| KR | 10-1998-080378 | | 11/1998 |
| KR | 10-0268848 | | 7/2000 |
| KR | 10-0742420 | | 7/2007 |
| KR | 10-2008-0027913 | | 3/2008 |
| KR | 10-2008-0062269 | | 7/2008 |
| KR | 10-0848022 | | 7/2008 |
| KR | 10-2009-0121975 | | 11/2009 |

OTHER PUBLICATIONS

International Search Report from the Korean Intellectual Property Office for International Application No. PCT/KR2012/011732 dated Apr. 25, 2013.

* cited by examiner

*Primary Examiner* — Weiping Zhu
(74) *Attorney, Agent, or Firm* — Cantor Colburn LLP

(57) ABSTRACT

Disclosed are a non-oriented electrical steel sheet and a method of manufacturing the same. The non-oriented electrical steel sheet of the present invention includes 0.005 wt % or less of C, 1.0-4.0 wt % of Si, 0.1-0.8 wt % of Al, 0.01-0.1 wt % of Mn, 0.02-0.3 wt % of P, 0.005 wt % or less of N, 0.001-0.005 wt % of S, 0.005 wt % or less of Ti, 0.01-0.2 wt % of at least one of Sn and Sb, and the remainder including Fe and other impurities unavoidably added thereto, wherein Mn, Al, P, and S may respectively fulfill the empirical formula $0.8 \leq \{[Mn]/(100*[S])+[Al]\}[P] \leq 40$, wherein [Mn], [Al], [P], and [S] respectively refer to weight percentages of Mn, Al, P, and S.

5 Claims, No Drawings

NON-ORIENTED ELECTRICAL STEEL SHEET AND METHOD OF MANUFACTURING THE SAME

CROSS REFERENCE TO RELATED APPLICATIONS

This application is a national phase application based on PCT/KR2012/011732, filed Dec. 28, 2012, which claims the priority of Korean Patent Application Nos. 10-2011-0145175, filed Dec. 28, 2011 and 10-2011-0145305, filed Dec. 28, 2011, the contents of all of which are incorporated herein by reference.

TECHNICAL FIELD

The present invention relates to a non-oriented electrical steel sheet. More particularly, the present invention relates to a non-oriented electrical steel sheet with improved magnetism by optimizing contents of Mn, S, Al, and P contained therein.

BACKGROUND ART

A non-oriented electrical steel sheet is used as a material for an iron core in rotary devices such as motors and generators, and stationary devices such as small transformers, and plays an important role in determining energy efficiency in electric devices.

The representing characteristics of the electrical steel sheet may include iron loss and magnetic flux density. In general, it is preferable that the iron loss becomes smaller and the magnetic flux density becomes higher. This is because when a magnetic field is induced as the iron loss becomes small the energy being lost in the form of heat can be reduced, and as the magnetic flux density becomes high a larger magnetic field can be induced with the same amount of energy.

Accordingly, in order to comply with the growing demand for reducing energy usage, and environmentally-friendly products, it is necessary to develop a technology for manufacturing a non-oriented electrical steel sheet.

Representing methods of improving iron loss among the magnetic properties of the non-oriented electrical steel sheet may include a method of reducing the thickness of the steel sheet, and a method of adding elements such as Si and Al, which have relatively high resistivity.

However, there is a problem in that the thickness is generally determined based on the characteristics of the product being used, and the thinner the thickness the higher the production cost and the lower the productivity.

In reducing the iron loss by increasing electrical resistivity of a conventional material by adding alloy elements such as Si, Al, Mn, etc., which have relative high resistivity, the method may reduce the iron loss with the addition of the alloy elements but there is a discrepancy that the decrease in saturated magnetic flux density will eventually lead to a decrease in the magnetic flux density.

Further, when the amount of Si being added becomes 4% or higher, it deteriorates the processability and makes the process of cold rolling difficult, thereby reducing productivity. Furthermore, as the amount of Al, Mn, etc., being added increases, the rolling is deteriorated and the hardness increases thereby reducing productivity.

Meanwhile, C, S, N, Ti, etc., which are impurity elements essentially added to steel, bind to Mn, Cu, Ti, etc. and form fine inclusions with a size of about 0.05 μm, thereby preventing the growth of grains and magnetic domains, and as a result, magnetic properties of the steel are deteriorated.

It is difficult to maintain these impurities at an extremely low level using a conventional manufacturing process, and the inclusions themselves are also hard to control because they undergo re-dissolution and precipitation according to their respective manufacturing processes.

Therefore, a technology for manufacturing clean steel by increasing a texture {100}, which is useful for improving magnetic properties, via the addition of a small amount of an alloy element in order to improve the magnetic flux density while lowering iron loss, and by reducing a texture {111}, which is a harmful set texture or by extremely lowering the amount of impurities, has been used.

However, the technology has drawbacks in that it increases production cost and has difficulties in mass production. Therefore, there is a need for the development of an improved technology that improves magnetism while preventing the increase in production cost.

The above information disclosed in this Background section is only for enhancement of understanding of the background of the invention and therefore it may contain information that does not form the prior art that is already known in this country to a person of ordinary skill in the art.

DISCLOSURE

Technical Problem

The present invention has been made in an effort to resolve the problems described above, and aims to provide a non-oriented electrical steel sheet with improved growth of grains and mobility of magnetic wall and a method of manufacturing the same by optimizing the contents of Mn, S, Al, and P among alloy elements of steel, thereby preventing the generation of fine inclusions while decreasing the amount of Mn and Al to be added and increasing the distribution density of coarse inclusions.

Technical Solution

An exemplary embodiment of the present invention provides a non-oriented electrical steel sheet which includes 0.005 wt % or less of carbon (C), 1.0-4.0 wt % of silicon (Si), 0.1-0.8 wt % of aluminum (Al), 0.01-0.1 wt % of manganese (Mn), 0.02-0.3 wt % of phosphorous (P), 0.005 wt % or less of nitrogen (N), 0.001-0.005 wt % of sulfur (S), 0.005 wt % or less of titanium (Ti), 0.01-0.2 wt % of at least one of tin (Sn) and antimony (Sb), and the remainder including Fe and other impurities unavoidably added thereto, wherein Mn, Al, P, and S may respectively fulfill the empirical formula $0.8 \leq \{[Mn]/(100*[S])+[Al]\}/[P] \leq 40$, wherein [Mn], [Al], [P], and [S] respectively refer to weight percentages of Mn, Al, P, and S.

The non-oriented electrical steel sheet may include 0.01-0.05 wt % of Mn.

The non-oriented electrical steel sheet may include 0.3-0.8 wt % of Al and fulfill [Mn]<[P], wherein [Mn] and [P] respectively refer to weight percentages of Mn and P.

The impurities unavoidably added to the non-oriented electrical steel sheet may include at least one selected from Cu, Ni, Cr, Zr, Mo, and V, and Cu, Ni, and Cr are respectively added in an amount of 0.05 wt % or less, while Zr, Mo, and V are respectively added in an amount of 0.01 wt % or less.

The non-oriented electrical steel sheet may have a ratio ($N_{S \geq 0.1\ \mu m}/N_{Tot}$) of 0.5 or greater between a number of MnS, CuS and (Mn, Cu)S complex sulfides ($N_{S\geq 0.1\ \mu m}$) having a size of 0.1 μm or greater and a total number of inclusions ($N_{Tot}$) having a size of 0.01-1 μm is 0.5 or greater.

The non-oriented electrical steel sheet may have inclusions within the steel sheet, wherein the average size of all inclusions, which have a size of 0.01-1 μm and include sulfides, may be 0.11 μm or above.

The size of grains within the microstructures of the non-oriented electrical steel sheet may be 50-180 μm.

Another exemplary embodiment of the present invention provides a method of manufacturing a non-oriented electrical steel sheet, the method including: providing a slab, which includes 0.005 wt % or less of C, 1.0-4.0 wt % of Si, 0.1-0.8 wt % of Al, 0.01-0.1 wt % of Mn, 0.02-0.3 wt % of P, 0.005 wt % or less of N, 0.001-0.005 wt % of S, 0.005 wt % or less of Ti, 0.01-0.2 wt % of at least one of Sn and Sb, and the remainder including Fe and other impurities unavoidably added thereto, in which Mn, Al, P, and S may respectively fulfill the following empirical formula, $0.8\leq\{[Mn]/(100*[S])+[Al]\}/[P]\leq 40$, wherein [Mn], [Al], [P], and [S] respectively refer to weight percentages of Mn, Al, P, and S; manufacturing a hot rolled steel sheet by heating the slab at 1200° C. or below followed by rolling; manufacturing a cold rolled steel sheet by pickling the hot rolled steel sheet followed by rolling to 0.10-0.70 mm; and conducting finishing annealing of the cold rolled steel sheet at 850-1100° C.

In the method of manufacturing a non-oriented electrical steel sheet, the slab may include 0.01-0.05 wt % of Mn.

In the method of manufacturing a non-oriented electrical steel sheet, the slab may include 0.3-0.8 wt % of Al, and fulfill the equation [Mn]<[P], wherein [Mn] and [P] respectively refer to weight percentages of Mn and P.

Advantageous Effects

According to the present invention, a non-oriented electrical steel sheet with excellent magnetism may be provided by optimizing the contents of Mn, S, Al, and P among alloy elements of steel, thereby preventing the generation of fine inclusions while decreasing the amount of Mn and Al to be added and increasing the distribution density of coarse inclusions, and as a result, improving the growth of grains and mobility of a magnetic wall.

Further, according to the present invention, Mn can bind to S and the like in steel and form an inclusion and thereby deteriorate the magnetism of the steel, and can also promote the growth of grains and mobility of magnetic domains by preventing the generation of fine inclusions, thereby improving the magnetism of the non-oriented electrical steel sheet.

In addition, as the contents of the Mn, Al, etc. are reduced, the saturated magnetic flux density increases, and as a result, it is possible to provide a non-oriented electrical steel sheet with excellent high frequency magnetism which represents high magnetic flux density.

MODE FOR INVENTION

Exemplary embodiments of the present invention will be described in detail below with reference to the accompanying drawings. While the present invention is shown and described in connection with exemplary embodiments thereof, it will be apparent to those skilled in the art that various modifications can be made without departing from the spirit and scope of the invention.

Like reference numerals refer to like elements throughout the specification.

Preferred exemplary embodiments of a non-oriented electrical steel sheet of the present invention will be described below.

In an exemplary embodiment of the present invention, the non-oriented electrical steel sheet may include 0.005 wt % or less of C, 1.0-4.0 wt % of Si, 0.1-0.8 wt % of Al, 0.01-0.1 wt % of Mn, 0.02-0.3 wt % of P, 0.005 wt % or less of N, 0.001-0.005 wt % of S, 0.005 wt % or less of Ti, 0.01-0.2 wt % of at least one of Sn and Sb, and the remainder including Fe and other impurities unavoidably added thereto, The Mn, Al, P, and S respectively fulfill the empirical formula below.

$$0.8\leq\{[Mn]/(100*[S])+[Al]\}/[P]\leq 40, \qquad \text{Empirical Formula}$$

Herein, Mn, Al, P, and S may respectively fulfill the empirical formula when [Mn], [Al], [P], and [S] respectively refer to weight percentages thereof.

In general, Mn increases resistivity of steel along with Al and Si thereby reducing iron loss, and thus Mn is added at at least 0.1 wt % when manufacturing the non-oriented electrical steel sheet.

However, Mn binds to S and forms a deposition of MnS. Further, S, as an element of impurities, binds to Cu and forms CuS or $Cu_2S$. That is, S forms a sulfide by binding with Mn and Cu, and the sulfide is formed as a single inclusion such as MnS and CuS or a complex inclusion of (Mn,Cu)S.

In general, the inclusions of a non-oriented electrical steel sheet are fine with a size of about 0.05 μm, and their magnetism is greatly affected by preventing the growth of grains and movement of a magnetic domain wall, and thus the frequency of forming coarse inclusions need to be increased in order to minimize the deterioration of magnetism.

Al, which is added as a resistivity element, also forms a fine nitride and thus contributes to the deterioration of magnetism. It has been known in the related art that the decrease in the amount of Mn and Al addition causes the inclusions to become fine.

According to the present invention, when the contents of elements Mn, Al, P, and S are regulated to fulfill the empirical formula $0.8\leq\{[Mn]/(100*[S])+[Al]\}/[P]\leq 40$, wherein [Mn], [S], [Al], and [P] respectively refer to weight percentage of Mn, S, Al, and P, if the amount of Mn and Al decreases, the average size of the inclusions in the range of 0.01-1 μm becomes coarse, as opposed to the expectation that the inclusions will become fine.

Further, the ratio ($N_{S\geq 0.1\ \mu m}/N_{Tot}$) between the number of MnS, CuS alone, or (Mn, Cu)S complex sulfides ($N_{S\geq 0.1\ \mu m}$) having a size of 0.1 μm or greater and the total number of inclusions ($N_{Tot}$) having a size of 0.01-1 μm becomes coarse to be 0.5 or greater.

In other words, by controlling distribution density of the inclusions within the electrical steel sheet, an excellent non-oriented electrical steel sheet having low iron loss and high magnetic flux density may be obtained even when minimum amounts of alloy elements are added.

More specifically, in the present invention, the respective amount of Mn, Al, P, and S was defined as shown in the empirical formula above because the Mn/S ratio is important in determining the distribution and size of inclusions, in particular, the distribution and size of sulfides, the amount of Al added is also important because Al is an element that forms fine inclusions, especially nitrides, and P, being an element for segregation in the grain boundary, the ratio of the amount of Mn, Al, and S to be added, and an appropriate ratio of P content that affect the formation of inclusions may have a great impact on removing the inhibitory force against grain growth and the improvement of magnetism via coarsening of inclusions.

That is, when the value of the empirical formula is smaller than 0.8 or larger than 40, the coarsening of inclusions cannot be achieved but the distribution density of fine inclusions increases, thereby deteriorating magnetism by preventing the growth of grains and movement of magnetic domains, etc.

Further, the ratio ($N_{S\geq 0.1\ \mu m}/N_{Tot}$) between the number of MnS, CuS, and (Mn, Cu)S complex sulfides ($N_{S\geq 0.1\ \mu m}$) having a size of 0.1 μm or greater, and the total number of inclusions ($N_{Tot}$) having a size of 0.01-1 μm, is 0.5 or greater.

In addition, the average size of the total inclusions, which have a size of 0.01-1 μm within the electrical steel sheet and include sulfides, is preferably 0.11 μm or greater.

Further, the size of the ferrite grains within the microstructure of the electrical steel sheet is 50-180 μm. When the size of the ferrite grains increases it becomes advantageous because hysteresis loss among iron loss decreases, however, eddy current loss among iron loss increases and thus the size of grains that minimize the iron loss is preferably restricted as described above.

The amount of the components of the non-oriented electrical steel sheet of the present invention is restricted for the following reasons.

Si: 1.0-4.0 wt %

Si is an element that is added in order to increase the resistivity of steel thereby reducing the eddy current loss among iron losses. When Si content is 1.0 wt % or less, it is difficult to attain a low iron loss characteristic. In contrast, when the amount of Si added exceeds 4.0 wt %, it causes breakage of a steel sheet during cold rolling, and thus it is preferable that Si content be restricted in the range of 1.0-4.0 wt %.

Mn: 0.01-0.1 wt %

Mn has an effect to reduce iron loss by increasing the resistivity of steel along with Si, Al, etc., and therefore Mn has been added in the conventional non-oriented electrical steel sheet in order to improve iron loss by adding at least 0.1 wt % or higher of Mn.

However, Mn has drawbacks that as the amount of Mn added increases the saturated magnetic flux density decreases, thus decreasing magnetic flux density, and also Mn binds to S to form a fine MnS inclusion, thereby preventing the growth of grains and mobility of a magnetic wall, and as a result, particularly hysteresis loss among iron losses increases.

Accordingly, the amount of Mn addition is restricted to be in the range of 0.01-0.1 wt % in order to prevent the increase in iron loss due to inclusions and to improve magnetic flux density.

Meanwhile, in an exemplary embodiment of the present invention, the amount of Mn may be maintained in the range of 0.01-0.05 wt %.

Al: 0.1-0.8 wt %

Al is an element inevitably added for steel deoxidation during steel manufacture. Al is also a major element that increases resistivity, and is thus added in a large amount to reduce iron loss, but it also decreases saturated magnetic flux density once added.

Further, when the amount of Al added is extremely low at less than 0.1 wt %, it results in formation of fine AlN, which in turn prevents the growth of grains that deteriorate magnetism. When Al is added at more than 0.8 wt % it causes a decrease in the magnetic flux density, and thus it is preferable that Al be added in the amount of 0.1-0.8 wt %.

Meanwhile, in another exemplary embodiment of the present invention, if the amount of Al is increased to be added in the range of 0.3-0.8 wt % while P is added to be at least greater than that of Mn in order to fulfill the equation [Mn]<[P], it may improve magnetism while preventing the formation of fine deposits even when the amount of Mn added increases.

P: 0.02-0.3 wt %

P increases resistivity and thus reduces iron loss, and is added for preventing the formation of a texture {111} which is harmful to magnetism via segregation to the grain boundary while forming a texture {100} which is useful for magnetism. When P is added at greater than 0.3 wt %, it deteriorates the rolling property and reduces the effect of improving magnetism, and it is preferable that P be added in the range of 0.02-0.3 wt %.

Further, Mn is an element that prevents the formation of ferrite while P is an element that expands the formation of ferrite. By adding a greater amount of P than that of Mn in order to fulfill the equation [Mn]<[P], it is possible to work in a more stable ferrite phase during hot rolling and annealing, and thus improve a texture desirable to magnetism, thereby improving high frequency magnetism.

C: 0.005 wt % or less

When C is added excessively it expands the austenite region, increases the phase transformation section, prevents the grain growth of ferrite during annealing thereby increasing iron loss, forms a carbide by binding to Ti, etc., thereby deteriorating magnetism, and increases iron loss due to magnetic aging if it is used in a final product after being processed into an electric product and used. Therefore, the amount of C to be added is restricted to 0.005 wt % or less.

S: 0.001-0.005 wt % or less

S is an element which forms sulfides such as MnS, CuS, (Cu,Mn)S, etc., which are harmful to magnetic properties and is thus preferably added as little as possible. However, when S is added in the amount of 0.001 wt % or less, it is not advantageous to the formation of a texture and deteriorates magnetism and thus S is preferably added 0.001 wt % or higher. When S is added at greater than 0.005 wt %, it increases fine sulfides which deteriorates magnetism. Therefore, the amount of S is restricted to be in the range of 0.001-0.005 wt %.

N: 0.005 wt % or less

N is a harmful element to magnetism and strongly binds to Al, Ti, etc., to form a nitride thereby preventing grain growth and the like. Therefore, it is preferable to be added as little as possible, and in the present invention, N is restricted to be added in the amount of 0.005 wt % or less.

Ti: 0.005 wt % or less

Ti along with a fine carbide forms a nitride and prevents grain growth.

The increase in Ti addition leads to the deterioration of texture due to the increased carbides and nitrides, thereby worsening the magnetism. Accordingly, in the present invention, the amount of Ti is restricted to be in the range of 0.005 wt % or less.

Sn or Sb: 0.01-0.2 wt %

Sn and Sb, being elements in the grain boundary (segregates), prevent the diffusion of nitrogen via the grain boundary, prevent the texture {111}, which is harmful to magnetism, and increase the texture {100}, which is advantageous to magnetism, thereby improving a magnetic property.

If Sn and Sb alone or their combined amount exceeds 0.2 wt %, it prevents the growth of grains thereby deteriorating magnetism and rolling quality. Therefore, it is preferable that Sn and Sb alone or their combined amount be in the range of 0.01-0.2 wt %.

The impurities added inevitably include Cu, Ni, Cr, Zr, Mo, and V. Cu, Ni, and Cr are added in the amount of 0.05 wt % or less, and Zr, Mo, and V are added in the amount of 0.01 wt % or less.

The impurities may be inevitably added during a steel manufacturing process. Cu, Ni, and Cr, for example, react with impurities elements to form fine sulfides, carbides, and nitrides, thereby rendering a harmful impact on magnetism. Therefore, it is preferable that the above elements be added in the range of 0.05 wt % or less, respectively.

Further, Zr, Mo, V, etc., are also strong carbonitride-forming elements and are thus preferably not added, and may be added in the amount of 0.01 wt % or less, respectively.

Elements other than those described above may include other inevitable impurities that may be added during the Fe and steel manufacturing process.

In another exemplary embodiment of the present invention, a method of manufacturing a non-oriented electrical sheet is provided.

A slab is provided, which includes 0.005 wt % or less of C, 1.0-4.0 wt % of Si, 0.1-0.8 wt % of Al, 0.01-0.1 wt % of Mn, 0.02-0.3 wt % of P, 0.005 wt % or less of N, 0.001-0.005 wt % of S, 0.005 wt % or less of Ti, 0.01-0.2 wt % of at least one of Sn and Sb, and the remainder including Fe and other impurities unavoidably added thereto, wherein Mn, Al, P, and S may respectively fulfill the empirical formula $0.8 \leq \{[Mn]/(100*[S])+[Al]\}/[P] \leq 40$, wherein [Mn], [Al], [P], and [S] respectively refer to wt % of Mn, Al, P, and S.

Herein, Mn, Al, P, and S may respectively fulfill the empirical formula below.

$$0.8 \leq \{[Mn]/(100*[S])+[Al]\}/[P] \leq 40,$$

Herein, [Mn], [Al], [P], and [S] respectively refer to weight percentages of Mn, Al, P, and S, and are heated at 1200° C. or below and then rolled, thereby manufacturing a hot rolled steel sheet.

If the heating temperature is 1200° C. or above, the deposition such as AlN, Mn, etc., present within the slab is re-solutionized, and then forms fine precipitates during hot rolling, thereby preventing the growth of grains and deteriorating magnetism. Accordingly, the temperature of reheating is restricted to be 1200° C. or below.

The finish rolling in strip milling during the hot rolling is terminated in the ferrite phase, and the final reduction ratio is restricted to be 20% or less for the correction of the plate profile.

As described above, the thus manufactured hot rolling steel sheet is wound at 700° C. or below, and cooled down in the air. The hot rolled steel sheet which is wound and cooled down undergoes annealing for the hot rolled sheet, pickling as necessary, cold rolling, and finally annealing of the cold rolled sheet.

Hot rolled sheet annealing is performed when it is necessary to improve the magnetic property of a hot rolled sheet, and the annealing temperature of the hot rolled sheet is set in the range of 850-1150° C. When the annealing temperature of the hot rolled sheet is below 850° C., grain growth becomes insufficient. In contrast, when the annealing temperature exceeds 1150° C., the grains grow excessively, and the defects on the surface become excessive. Therefore, the annealing temperature is set in the range of 850-1150° C.

A pickled hot rolled steel sheet or an annealed hot rolled steel sheet formed by a conventional method is subjected to cold rolling.

Cold rolling is performed to a final rolling to a thickness of from 0.10 mm to 0.70 mm. If necessary, secondary cold rolling may be performed between the primary cold rolling and the intermediate annealing, and the final reduction ratio is set in the range of 50-95%.

The final cold rolled steel sheet is subjected to a cold rolled sheet annealing (finishing annealing). During the annealing process, the temperature for the cold rolled sheet annealing (finishing annealing) is set in the range of 850-1100° C.

When the temperature for the cold rolled sheet annealing (finishing annealing) is 850° C. or below, the growth of grains become insufficient, and the texture {111} which is harmful to the magnetism increases, whereas when the temperature is 1100° C. or above, there is an excess growth of grains, which gives a negative impact on magnetism. Accordingly, the temperature for the cold rolled sheet annealing (finishing annealing) is set in the range of 850-1100° C.

Then, the annealed sheet may be coated with an insulation film.

The method of manufacturing a non-oriented electrical steel sheet of the present invention is explained in greater detail according to exemplary embodiments of the present invention as described below. However, the exemplary embodiments are suggestive of the present invention and should not be construed as limiting the scope of the present invention.

Example 1

Steel ingots were manufactured via vacuum melting according to the compositions as shown in Table 1, and variation in the amounts of Mn, Al, P, and S were observed. Each steel ingot was heated at 1180° C., subjected to hot rolling to a thickness of 2.1 mm, and then wound. The hot rolled steel sheet wound and cooled down in the air was annealed at 1080° C. for 3 minutes, subjected to pickling, and cold rolled to a thickness of 0.35 mm, and the cold rolled sheet was subjected to final annealing at 1050° C. for 90 seconds. For each sample, the number of inclusions having a size of 0.01-1 μm, the number of sulfides having a size of 0.1 μm or above, iron loss, and magnetic flux density were measured, and the results are shown in Table 2 below.

TABLE 1

| Steel Type | C | Si | Mn | P | S | Al | N | Ti | Sn | Sb | Remarks |
|---|---|---|---|---|---|---|---|---|---|---|---|
| A1 | 0.0022 | 1.5 | 0.04 | 0.15 | 0.0044 | 0.2 | 0.0025 | 0.0014 | 0.025 | 0 | Example |
| A2 | 0.0027 | 2.4 | 0.05 | 0.12 | 0.0037 | 0.22 | 0.0021 | 0.0016 | 0.035 | 0.023 | Example |
| A3 | 0.0013 | 2.6 | 0.01 | 0.06 | 0.0031 | 0.19 | 0.0014 | 0.001 | 0.013 | 0.026 | Example |

TABLE 1-continued

| Steel Type | C | Si | Mn | P | S | Al | N | Ti | Sn | Sb | Remarks |
|---|---|---|---|---|---|---|---|---|---|---|---|
| A4 | 0.0022 | 2.0 | 0.004 | 0.23 | 0.0048 | 0.005 | 0.0026 | 0.001 | 0.044 | 0 | Comparative Example |
| A5 | 0.0025 | 2.6 | 0.03 | 0.07 | 0.0034 | 0.42 | 0.0021 | 0.0009 | 0.013 | 0.026 | Comparative Example |
| A6 | 0.0022 | 2.8 | 0.04 | 0.02 | 0.0028 | 0.16 | 0.0017 | 0.002 | 0 | 0.015 | Example |
| A7 | 0.0019 | 2.9 | 0.07 | 0.03 | 0.0012 | 0.29 | 0.0019 | 0.0009 | 0.026 | 0.022 | Example |
| A8 | 0.0024 | 2.8 | 0.08 | 0.007 | 0.0021 | 0.13 | 0.0019 | 0.0016 | 0.029 | 0.05 | Comparative Example |
| A9 | 0.0029 | 2.8 | 0.06 | 0.02 | 0.0011 | 0.29 | 0.0016 | 0.0017 | 0 | 0.028 | Comparative Example |
| A10 | 0.0033 | 3.2 | 0.11 | 0.02 | 0.0029 | 0.5 | 0.0015 | 0.0025 | 0 | 0.048 | Comparative Example |
| A11 | 0.0029 | 3.1 | 0.06 | 0.07 | 0.0038 | 0.3 | 0.0026 | 0.0016 | 0.019 | 0 | Example |
| A12 | 0.0025 | 3.3 | 0.04 | 0.04 | 0.0025 | 0.27 | 0.0016 | 0.0012 | 0 | 0.025 | Example |
| A13 | 0.0035 | 3.5 | 0.03 | 0.03 | 0.0013 | 0.15 | 0.0039 | 0.0015 | 0.025 | 0.016 | Example |
| A14 | 0.0025 | 3.3 | 0.12 | 0.06 | 0.0064 | 0.29 | 0.0015 | 0.0019 | 0 | 0.021 | Comparative Example |
| A15 | 0.0024 | 3.5 | 0.1 | 0.05 | 0.0007 | 0.18 | 0.0041 | 0.0016 | 0 | 0.036 | Comparative Example |

TABLE 2

| Steel type | {[Mn]/(100 × [S]) + [Al]}/[P] | 0.01-1 μm Inclusion Average size (μm) | $N_{S=0.1\ \mu m}/N_{Tot}$ [1)] | Iron loss $W_{15/50}$ [2)] | Magnetic flux density $B_{50}$ [3)] | Remarks |
|---|---|---|---|---|---|---|
| A1 | 1.9 | 0.155 | 0.57 | 2.30 | 1.77 | Example |
| A2 | 3.0 | 0.137 | 0.62 | 2.23 | 1.76 | Example |
| A3 | 3.7 | 0.133 | 0.58 | 1.92 | 1.75 | Example |
| A4 | 0.1 | 0.088 | 0.39 | 2.91 | 1.69 | Comparative Example |
| A5 | 7.3 | 0.095 | 0.43 | 2.77 | 1.70 | Comparative Example |
| A6 | 15.1 | 0.156 | 0.68 | 1.87 | 1.76 | Example |
| A7 | 29.1 | 0.128 | 0.61 | 2.02 | 1.74 | Example |
| A8 | 73.0 | 0.098 | 0.45 | 2.79 | 1.67 | Comparative Example |
| A9 | 41.8 | 0.103 | 0.48 | 2.67 | 1.67 | Comparative Example |
| A10 | 44.0 | 0.091 | 0.41 | 2.53 | 1.65 | Comparative Example |
| A11 | 6.5 | 0.135 | 0.66 | 2.04 | 1.73 | Example |
| A12 | 10.8 | 0.151 | 0.7 | 1.97 | 1.73 | Example |
| A13 | 12.7 | 0.163 | 0.67 | 1.85 | 1.71 | Example |
| A14 | 8.0 | 0.093 | 0.33 | 2.55 | 1.65 | Comparative Example |
| A15 | 32.2 | 0.102 | 0.41 | 2.51 | 1.64 | Comparative Example |

1) ($N_{S=0.1\ \mu m}/N_{Tot}$) refers to the ratio of the number of MnS, CuS, or complex sulfides having a size of 0.1 μm or above to the total number of inclusions having a size of 0.01-1 μm.
2) Iron loss, $W_{15/50}$, refers to the average loss (W/kg) of a rolling direction and a vertical direction to the rolling direction when magnetic flux density of 1.5 Tesla was discarded at a 50 Hz frequency.
3) Magnetic flux density, $B_{50}$, refers to the size of a magnetic flux density (Telsa) induced when a magnetic field applied is 5000 A/m.

In the present invention, in order to analyze the size, types, and distribution of inclusions, carbon replicas extracted from samples were observed under a Transmission Electron Microscope (TEM) and analyzed via EDS spectroscopy.

The TEM observation was performed on regions selected randomly without prejudice under magnification which was predetermined to enable a clear observation of inclusions with a size of 0.01 μm or above. At least 100 sheets were photographed as images and the size and distribution of all the inclusions that appeared were measured therefrom, and also the types of inclusions such as carbon nitrides, pyrites, etc., were analyzed using EDS spectroscopy.

In analyzing the size and distribution of inclusions of the present invention, when the size of the inclusions is 0.01 μm or less it is difficult to observe and measure the inclusions, and their effect on the magnetism is minimal. Further, oxides such as $SiO_2$ and $Al_2O_3$ with a size of 1 μm or above were also observed, but the $SiO_2$ and $Al_2O_3$ had minimal effect on magnetism and thus they were not included as objects to be analyzed in the present invention.

As shown in Table 2, the steel types A1, A2, A3, A6, A7, A11, A12, and A13 of the present invention, which satisfy [Mn], [Al], [P], and [S], and the empirical formula $0.8 \leq \{[Mn]/(100*[S])+[Al]\}/[P] \leq 40$, had inclusions with an average size of 0.11 μm or above to the inclusions with a size in the range of 0.01-1 μm. Furthermore, the ratio ($N_{S \geq 0.1 \mu m}/N_{Tot}$) of the number of MnS, CuS, or complex sulfides with a size of 0.1 μm or above to the number of inclusions with a size in the range of 0.01-1 μm was shown to be 0.5 or higher, and as a result, iron loss was low but magnetic flux density was high.

In contrast, in the steel types A4, A8, and A10, Mn, P, Al, etc., failed to fulfill the empirical formula because of being outside the range to be maintained, and the average size of the inclusions in the range of 0.01-1 μm was fine to be 0.11 μm or less. Furthermore, the ratio ($N_{S\geq 0.1\mu m}/N_{Tot}$) of the number of MnS, CuS, or complex sulfides with a size of 0.1 μm or above to the number of the inclusions with a size in the range of 0.01-1 μm was shown to be 0.5 or less, thus showing deterioration in iron loss and magnetic flux density.

In the steel types A5, A14, and A15, Al, Mn, and P were away from the range to be maintained, and as a result, the average size of the inclusions in the range of 0.01-1 μm was found to be 0.11 μm or less. Furthermore, the ratio ($N_{S\geq 0.1\mu m}/N_{Tot}$) of the number of MnS, CuS, or complex sulfides with a size of 0.1 μm or above to the number of inclusions with a size in the range of 0.01-1 μm was shown to be 0.5 or less, thus showing deterioration in iron loss and magnetic flux density.

In the steel type A9, Mn, P, S, and Al satisfied the component management range but failed to fulfill the empirical formula, and as a result, the average size of the inclusions in the range of 0.01-1 μm was found to be 0.11 μm or less. Furthermore, the ratio ($N_{S\geq 0.1\mu m}/N_{Tot}$) of the number of MnS, CuS, or complex sulfides with a size of 0.1 μm or above to the number of inclusions with a size in the range of 0.01-1 μm was shown to be 0.5 or less, thus showing deterioration in iron loss and magnetic flux density.

Example 2

Steel ingots were manufactured via vacuum melting according to the compositions as shown in Table 3. In this case, the effect of the annealing temperature for hot rolled sheet and the annealing temperature for cold rolled sheet on the size, distribution, and magnetism of inclusions were examined. Each steel ingot was heated at 1180° C., subjected to hot rolling to a thickness of 2.1 mm, and then wound. The hot rolled steel sheet wound and cooled down in the air was annealed at 800-1200° C. for 2 minutes, subjected to pickling, and cold rolled to a thickness of 0.35 mm, and the cold rolled sheet was subjected to final annealing at 800-1200° C. for 50 seconds. For each sample, the number of inclusions having a size of 0.01-1 μm, the number of sulfides having a size of 0.1 μm or higher, iron loss, and magnetic flux density were measured, and the results are shown in Table 4 below.

TABLE 3

| Steel type | C | Si | Mn | P | S | Al | N | Ti | Sn | Sb | Remarks |
|---|---|---|---|---|---|---|---|---|---|---|---|
| B1 | 0.0012 | 1.3 | 0.03 | 0.14 | 0.0012 | 0.1 | 0.0029 | 0.0009 | 0.046 | 0.021 | Example |
| B2 | 0.0022 | 2.1 | 0.06 | 0.05 | 0.0019 | 0.18 | 0.0016 | 0.0025 | 0.021 | 0.025 | Example |
| B3 | 0.0035 | 2.5 | 0.05 | 0.11 | 0.0038 | 0.15 | 0.0035 | 0.0015 | 0.039 | 0 | Example |
| B4 | 0.0027 | 2.8 | 0.05 | 0.07 | 0.0021 | 0.21 | 0.0019 | 0.0016 | 0 | 0.041 | Example |
| B5 | 0.0021 | 1.7 | 0.07 | 0.11 | 0.0012 | 0.12 | 0.0022 | 0.0008 | 0.011 | 0.031 | Comparative Example |
| B6 | 0.0016 | 2.3 | 0.05 | 0.02 | 0.0019 | 0.29 | 0.0019 | 0.0023 | 0.035 | 0 | Comparative Example |
| B7 | 0.0025 | 2.4 | 0.07 | 0.08 | 0.0022 | 0.26 | 0.0022 | 0.0012 | 0 | 0.025 | Comparative Example |
| B8 | 0.0031 | 2.8 | 0.03 | 0.05 | 0.0017 | 0.22 | 0.0016 | 0.0019 | 0.029 | 0.011 | Example |
| B9 | 0.0019 | 3.0 | 0.05 | 0.08 | 0.0035 | 0.24 | 0.0023 | 0.0021 | 0.029 | 0.022 | Example |
| B10 | 0.0029 | 3.5 | 0.06 | 0.06 | 0.0037 | 0.29 | 0.0029 | 0.0015 | 0.045 | 0 | Example |
| B11 | 0.0023 | 3.5 | 0.04 | 0.03 | 0.003 | 0.13 | 0.0021 | 0.0011 | 0 | 0.036 | Example |
| B12 | 0.0033 | 2.8 | 0.07 | 0.05 | 0.0023 | 0.18 | 0.0025 | 0.0019 | 0.030 | 0 | Comparative Example |
| B13 | 0.0027 | 3.1 | 0.06 | 0.07 | 0.0016 | 0.3 | 0.0013 | 0.0016 | 0.032 | 0.03 | Comparative Example |
| B14 | 0.0016 | 3.3 | 0.05 | 0.04 | 0.0027 | 0.19 | 0.0026 | 0.0017 | 0 | 0.024 | Comparative Example |

TABLE 4

| Steel type | {Mn/(100 × [S]) + [Al]}/[P] | Hot rolled sheet Annealing temperature (° C.) | Cold rolled sheet Annealing temperature (° C.) | 0.01-1 μm Inclusion Average size (μm) | $N_{S\geq 0.1\mu m}/N_{Tot}$ | Iron loss $W_{15/50}$ | Magnetic flux density $B_{50}$ | Remarks |
|---|---|---|---|---|---|---|---|---|
| B1 | 2.5 | 1080 | 970 | 0.136 | 0.62 | 2.39 | 1.77 | Example |
| B2 | 9.9 | 1020 | 1010 | 0.145 | 0.55 | 2.25 | 1.75 | Example |
| B3 | 2.6 | 1040 | 1050 | 0.125 | 0.51 | 2.21 | 1.74 | Example |
| B4 | 6.4 | 990 | 1040 | 0.141 | 0.59 | 2.16 | 1.74 | Example |
| B5 | 6.4 | 830 | 1040 | 0.096 | 0.42 | 2.92 | 1.71 | Comparative Example |
| B6 | 27.7 | 1020 | 1120 | 0.100 | 0.46 | 2.85 | 1.68 | Comparative Example |
| B7 | 7.2 | 1170 | 990 | 0.107 | 0.31 | 2.65 | 1.67 | Comparative Example |
| B8 | 7.9 | 1040 | 1050 | 0.166 | 0.53 | 1.89 | 1.76 | Example |
| B9 | 4.8 | 1080 | 1030 | 0.148 | 0.55 | 1.96 | 1.76 | Example |
| B10 | 7.5 | 1100 | 990 | 0.114 | 0.58 | 2.03 | 1.72 | Example |
| B11 | 8.8 | 1050 | 1040 | 0.138 | 0.61 | 1.94 | 1.71 | Example |

TABLE 4-continued

| Steel type | {Mn/(100 × [S]) + [Al]}/[P] | Hot rolled sheet Annealing temperature (° C.) | Cold rolled sheet Annealing temperature (° C.) | 0.01-1 μm Inclusion Average size (μm) | $N_{S-0.1\ \mu m}/N_{Tot}$ | Iron loss $W_{15/50}$ | Magnetic flux density $B_{50}$ | Remarks |
|---|---|---|---|---|---|---|---|---|
| B12 | 9.7 | 800 | 1050 | 0.098 | 0.35 | 2.61 | 1.66 | Comparative Example |
| B13 | 9.6 | 1180 | 1130 | 0.093 | 0.49 | 2.62 | 1.64 | Comparative Example |
| B14 | 9.4 | 1020 | 820 | 0.101 | 0.37 | 2.54 | 1.64 | Comparative Example |

As shown in Table 3, the steel types B1, B2, B3, B4, B8, B9, B10, and B11 of the present invention, which satisfy [Mn], [Al], [P], and [S] and the empirical formula 0.8≤{[Mn]/(100*[S])+[Al]}/[P]≤40, and the annealing temperature for the hot rolled sheet and the annealing temperature for the cold rolled sheet, had inclusions with an average size of 0.11 μm or above to the inclusions with a size in the range of 0.01-1 μm. Furthermore, the ratio ($N_{S\geq 0.1\mu m}/N_{Tot}$) of the number of MnS, CuS, or complex sulfides with a size of 0.1 μm or above to the number of inclusions with a size in the range of 0.01-1 μm was shown to be 0.5 or higher, and as a result, iron loss was low but magnetic flux density was high.

In contrast, the steel types B5, B7, and B12 satisfied [Mn], [Al], [P], and [S] and the empirical formula 0.8≤{[Mn]/(100×[S])+[Al]}/[P]≤40, but the annealing temperature for the hot rolled sheet was outside the range of the present invention, and the fraction ratio of fine inclusions increased and the average size of the inclusions having a size of 1 μm or less was 0.11 μm or less. Furthermore, the ratio ($N_{S\geq 0.1\mu m}/N_{Tot}$) of the number of MnS, CuS, or complex sulfides with a size of 0.1 μm or above to the number of inclusions with a size in the range of 0.01-1 μm was shown to be 0.5 or less, thus showing deterioration in iron loss and magnetic flux density.

Further, the steel types B6 and B14 satisfied [Mn], [Al], [P], and [S] and the empirical formula 0.8≤{[Mn]/(100×[S])+[Al]}/[P]≤40, but the annealing temperature for the cold rolled sheet was outside the range of the present invention, and the average size of the inclusions having a size of 1 μm or less was 0.11 μm or less. In addition, the ratio ($N_{S\geq 0.1\mu m}/N_{Tot}$) of the number of MnS, CuS, or complex sulfides with a size of 0.1 μm or above to the number of the inclusions with a size in the range of 0.01-1 μm was shown to be 0.5 or less, and grains were either too coarse or fine, thus showing deterioration in iron loss and magnetic flux density.

The steel type B13 satisfied [Mn], [Al], [P], and [S] and the empirical formula 0.8≤{[Mn]/(100×[S])+[Al]}/[P]≤40, but both the annealing temperature for the hot rolled sheet and the annealing temperature for the cold rolled sheet were off the range of the present invention, and the average size of the inclusions having a size of 1 μm or less was 0.11 μm or less. Furthermore, the ratio ($N_{S\geq 0.1\mu m}/N_{Tot}$) of the number of MnS, CuS, or complex sulfides with a size of 0.1 μm or above to the number of the inclusions with a size in the range of 0.01-1 μm was shown to be 0.5 or less, thus showing deterioration in magnetism.

A method for manufacturing a non-oriented electrical steel sheet according to another exemplary embodiment of the present invention will be described in detail below. However, the exemplary embodiment described below is only suggestive of the scope of the present invention and should not be construed as limiting the scope of the present invention.

In a method for manufacturing a non-oriented electrical steel sheet according to the current exemplary embodiment of the present invention, a non-oriented electrical steel sheet may increase ferrite phase expansion elements in a component system, which includes Si, Al, Mn, and P, i.e., adding 0.3-0.8 wt %, and also adding Mn in the amount of 0.01-0.2 wt % if adding the amount of P at at least greater than that of Mn, more preferably, limiting the amount of Mn in the range of 0.01-0.05 wt %, thereby increasing the distribution density of coarse inclusions while preventing the generation of fine inclusions such as AlN, etc., and as a result, improving high frequency magnetism.

Further, if the amount of Al is increased to 0.3-0.8 wt %, and P is included to be at least greater than that of Mn so as to fulfill the equation [Mn]<[P], the fine deposition can be prevented even with the increase in the amount of Mn and the magnetism can be improved. Accordingly, in a non-oriented electrical steel sheet including 0.3-0.8 wt % of Al and 0.001-0.005 wt % of S, if Mn is included in the amount of 0.01-0.05 wt % and P is included in the amount of 0.02-0.3 wt %, so that P is included at at least higher than that of Mn so as to fulfill the equation [Mn]<[P], the high frequency magnetism of the electrical steel sheet may be improved.

While Mn is an element that prevents the generation of ferrites, Al and P are elements which expand the generation of ferrites. Accordingly, by increasing the amount of Al and P, which are ferrite generating elements, a process can be made in a stable ferrite phase during the hot rolling and annealing, and P can be segregated to the grain boundary and develop a texture {100} well, which is advantageous to magnetism, thereby improving magnetism.

Example 3

Steel ingots were manufactured via vacuum melting according to the compositions as shown in Table 5 by varying the amount of Mn, Al, P, and S, and their impacts were investigated. Each steel ingot was heated at 1160° C., subjected to hot rolling to a thickness of 2.5 mm, and then wound. The hot rolled steel sheet wound and cooled down in the air was annealed at 1050° C. for 3 minutes, subjected to pickling, and cold rolled to a thickness of 0.35 mm, and the cold rolled sheet was subjected to final annealing at 1050° C. for 60 seconds. For each sample, the number of inclusions having a size of 0.01-1 μm, the number of sulfides having a size of 0.1 μm or above, iron loss, and magnetic flux density were measured, and the results are shown in Table 6 below.

TABLE 5

| Steel type | C | Si | Mn | P | S | Al | N | Ti | Sn | Sb | Remarks |
|---|---|---|---|---|---|---|---|---|---|---|---|
| C1 | 0.0025 | 1.4 | 0.04 | 0.25 | 0.004 | 0.31 | 0.0024 | 0.0015 | 0.025 | | Example |
| C2 | 0.0026 | 2.5 | 0.05 | 0.2 | 0.004 | 0.35 | 0.0022 | 0.0017 | 0.025 | | Example |
| C3 | 0.0019 | 2.5 | 0.01 | 0.06 | 0.003 | 0.4 | 0.0019 | 0.0021 | 0.011 | 0.01 | Example |
| C4 | 0.0023 | 2.4 | 0.001 | 0.23 | 0.005 | 0.007 | 0.0023 | 0.0018 | 0.025 | | Comparative Example |
| C5 | 0.0026 | 2.6 | 0.03 | 0.04 | 0.003 | 1.2 | 0.0013 | 0.0021 | 0.025 | 0.01 | Comparative Example |
| C6 | 0.0023 | 2.7 | 0.07 | 0.03 | 0.002 | 1.5 | 0.002 | 0.0025 | 0.029 | | Comparative Example |
| C7 | 0.0026 | 2.6 | 1.2 | 0.03 | 0.001 | 0.35 | 0.0019 | 0.0024 | | | Comparative Example |
| C8 | 0.0035 | 3.5 | 0.45 | 0.07 | 0.003 | 0.56 | 0.0025 | 0.0021 | | | Comparative Example |
| C9 | 0.0021 | 3.1 | 0.04 | 0.14 | 0.003 | 0.55 | 0.0017 | 0.0022 | | | Example |
| C10 | 0.0022 | 3.0 | 0.02 | 0.12 | 0.001 | 0.45 | 0.0018 | 0.0019 | 0.026 | | Example |
| C11 | 0.0025 | 3.4 | 0.05 | 0.25 | 0.004 | 0.8 | 0.0016 | 0.0025 | 0.019 | | Example |
| C12 | 0.0025 | 3.5 | 0.07 | 0.15 | 0.003 | 0.45 | 0.0016 | 0.0024 | | | Example |
| C13 | 0.0025 | 3.6 | 0.05 | 0.15 | 0.001 | 0.35 | 0.0019 | 0.0023 | 0.025 | | Example |
| C14 | 0.0025 | 3.4 | 0.07 | 0.04 | 0.006 | 0.45 | 0.0018 | 0.0022 | 0.025 | | Comparative Example |
| C15 | 0.0026 | 3.4 | 0.06 | 0.03 | 0.0004 | 0.35 | 0.0023 | 0.0023 | | 0.03 | Comparative Example |
| C16 | 0.0024 | 3.3 | 0.12 | 0.05 | 0.002 | 0.25 | 0.0019 | 0.002 | 0.025 | | Comparative Example |

TABLE 6

| Steel type | [Mn] < [P] | [{Mn/100 × S} + Al]/[P] | 0.01-1 μm Inclusion Average size (μm) | $N_{S=0.1\ \mu m}/N_{Tot}$ | Iron loss ($W_{10/400}$) | Magnetic flux density B50 | Remarks |
|---|---|---|---|---|---|---|---|
| C1 | ○ | 1.6 | 0.14 | 0.58 | 17.4 | 1.78 | Example |
| C2 | ○ | 2.4 | 0.13 | 0.55 | 16.5 | 1.79 | Example |
| C3 | ○ | 7.2 | 0.13 | 0.59 | 15.3 | 1.76 | Example |
| C4 | ○ | 0.04 | 0.08 | 0.35 | 19.3 | 1.69 | Comparative Example |
| C5 | ○ | 32.2 | 0.09 | 0.41 | 20.4 | 1.70 | Comparative Example |
| C6 | X | 61.1 | 0.10 | 0.35 | 21.5 | 1.69 | Comparative Example |
| C7 | X | 375.3 | 0.09 | 0.45 | 20.4 | 1.68 | Comparative Example |
| C8 | X | 30.2 | 0.06 | 0.46 | 22.0 | 1.69 | Comparative Example |
| C9 | ○ | 4.9 | 0.15 | 0.65 | 14.5 | 1.75 | Example |
| C10 | ○ | 5.1 | 0.14 | 0.66 | 15.1 | 1.78 | Example |
| C11 | ○ | 3.7 | 0.15 | 0.66 | 13.8 | 1.74 | Example |
| C12 | ○ | 4.9 | 0.13 | 0.71 | 14.3 | 1.76 | Example |
| C13 | ○ | 4.9 | 0.13 | 0.65 | 15.5 | 1.75 | Example |
| C14 | X | 14.0 | 0.08 | 0.43 | 21.1 | 1.66 | Comparative Example |
| C15 | X | 61.67 | 0.06 | 0.41 | 20.5 | 1.67 | Comparative Example |
| C16 | X | 17.0 | 0.07 | 0.42 | 20.9 | 1.68 | Comparative Example |

1) ( $N_{S=0.1\ \mu m}/N_{Tot}$) refers to the ratio of the number of MnS, CuS, or complex sulfides having a size of 0.1 μm or above to the total number of inclusions having a size of 0.01-1 μm.
2) Iron loss, $W_{10/400}$, refers to the average loss (W/kg) of a rolling direction and a vertical direction to the rolling direction when magnetic flux density of 1.0 Tesla was discarded at a 400 Hz frequency.
3) Magnetic flux density, $B_{50}$, refers to the size of a magnetic flux density (Telsa) induced when a magnetic field applied is 5000 A/m.

As shown in Table 6, in the range of components [Mn], [Al], [P], and [S], the steel types C1-C3 and C9-C13 of the present invention, which satisfy [Mn]<[P] and the empirical formula $0.8 \leq [\{[Mn]/(100*[S])\}+[Al]]/[P] \leq 40$, had inclusions with an average size of 0.11 μm or above to the inclusions with a size in the range of 0.01-1 μm. Furthermore, the ratio ($N_{S \geq 0.1 \mu m}/N_{Tot}$) of the number of MnS, CuS, or complex sulfides with a size of 0.1 μm or above to the number of inclusions with a size in the range of 0.01-1 μm was shown to be 0.5 or higher, and as a result, high frequency iron loss was low but magnetic flux density was high.

In contrast, in the steel types C4-C8 and C14-C16 of the comparative examples, Mn, P, Al, etc., were away from the range to be maintained thus failing to fulfill the composition correlation equation (1), and the average size of the inclusions having a size in the range of 0.01-1 μm was fine at 0.11 μm or less. Furthermore, the ratio ($N_{S \geq 0.1 \mu m}/N_{Tot}$) of the number of MnS, CuS, or complex sulfides with a size of 0.1 μm or above to the number of inclusions with a size in the range of 0.01-1 μm was shown to be 0.5 or less, thus showing deterioration in both iron loss and magnetic flux density at a high frequency.

Further, in the steel type C4 of the comparative example, the amounts of Mn and Al were both away from the range of the present invention to be maintained, the steel types C5 and C6 showed an excess in Al amount, and in the steel type C6, the amount of Mn was smaller than that of P. In the steel types C7 and C8, the amount of Mn was excessive and the amount of Mn was larger than that of P. In the steel types C14-C16, the amount of Mn was larger than that of P, and in particular, in the steel type C15, the amount of S was extremely low, and in the steel type C16, the amount of Al was less than 0.3 wt %. Accordingly, the average size of the inclusions having a size in the range of 0.01-1 μm was found to be 0.11 μm or less. Furthermore, the ratio ($N_{S\geq 0.1\mu m}/N_{Tot}$) of the number of MnS, CuS, or complex sulfides with a size of 0.1 μm or above to the number of inclusions with a size in the range of 0.01-1 μm was shown to be 0.5 or less, thus showing deterioration in both iron loss and magnetic flux density.

Example 4

A slab including 0.0025 w % of C, 2.89 w % of Si, 0.03 w % of Mn, 0.15 w % of P, 0.002 w % of S, 0.35 w % of Al, 0.0017 w % of N, 0.0011 w % of Ti, and the remainder including Fe and other impurities unavoidably added thereto was heated at 1150° C., manufactured into a hot rolled steel sheet with a thickness of 2.0 mm, wound at 650° C., and then cooled down in the air. The hot rolled sheet was continuously annealed and pickled for 3 minutes as shown in Table 7, subjected to cold rolling to a thickness of 0.2 mm, and the cold rolled sheet was annealed for 1 minute under an atmosphere of 70% nitrogen and 30% hydrogen. For each sample, the number of inclusions having a size of 0.01-1 μm, the number of sulfides having a size of 0.1 μm or above, iron loss, and magnetic flux density were measured. The iron loss and magnetic flux density were measured using a magnetism instrument, and the results are shown in Table 7 below.

TABLE 7

| Category | Hot rolled sheet temperature (° C.) | Cold rolled sheet annealing temperature (° C.) | 0.01-1 μm Inclusion average size (μm) | Iron loss ($W_{10/400}$) (W/kg) | Magnetic flux density $B_{50}$ | $N_{S=0.1\ \mu m}/N_{Tot}$ |
|---|---|---|---|---|---|---|
| Example 1 | 1050 | 950 | 0.135 | 10.9 | 1.71 | 0.65 |
| Example 2 | 1050 | 1000 | 0.126 | 9.5 | 1.71 | 0.55 |
| Example 3 | 1050 | 1050 | 0.137 | 10.1 | 1.72 | 0.58 |
| Comparative Example 1 | 800 | 1050 | 0.073 | 13.5 | 1.62 | 0.45 |
| Comparative Example 2 | 1200 | 800 | 0.102 | 12.9 | 1.63 | 0.35 |

As shown in Table 7, the annealing temperature for the hot rolled sheet and the annealing temperature for the cold rolled sheet in Examples 1-3 satisfied the range of the present invention. However, in Comparative Example 1, the annealing temperature for the hot rolled sheet was low, and in Comparative Example 2, the annealing temperature for the cold rolled sheet was low.

According to the exemplary embodiments of the present invention, although the component system satisfies [Mn]< [P], satisfies the Composition Equation 1, and also satisfies the annealing temperature for the hot rolled sheet and the annealing temperature for the cold rolled sheet, the average size of the inclusions having a size of 0.01-1 μm may vary, and the ratio ($N_{S\geq 0.1\mu m}/N_{Tot}$) of the number of MnS, CuS, or complex sulfides with a size of 0.1 μm or above to the number of inclusions with a size in the range of 0.01-1 μm may also vary.

Preferred embodiments of this invention are described herein. However, variations of those preferred embodiments may become apparent to those of ordinary skill in the art upon reading the foregoing description without departing from the main scope of the present invention. The inventors expect skilled artisans to employ such variations as appropriate, and the inventors intend for the invention to be practiced other than as specifically described herein.

Accordingly, it should be understood that all the exemplary embodiments described above are only suggestive and are not restrictive in any matter.

The range of the present invention is represented by the claimed range described below instead of the detailed description, and it should be understood that the meanings and scope of the claimed ranges, and any and all the modifications or modified forms derived from the equivalent concepts, are included in the protection scope of the present invention.

The invention claimed is:

1. A non-oriented electrical steel sheet comprising:

0.005 wt % or less of C, 1.0-4.0 wt % of Si, 0.1-0.8 wt % of Al, 0.01-0.05 wt % of Mn, 0.02-0.3 wt % of P, 0.005 wt % or less of N, 0.0012-0.005 wt % of S, 0.005 wt % or less of Ti, 0.01-0.2 wt % of at least one of Sn or Sb, the remainder including Fe and other impurities unavoidably added thereto, wherein Mn, Al, P, and S respectively fulfill an empirical formula below:

$$0.8\leq\{[Mn]/(100*[S])+[Al]\}/[P]\leq 40,$$

wherein [Mn], [Al], [P], and [S] respectively refer to weight percentages of Mn, Al, P, and S, and wherein a ratio to ($N_{S\geq 0.1\mu m}/N_{Tot}$) between a number of MnS, CuS, and (Mn, Cu)S complex sulfides ($N_{S\geq 0.1\mu m}$) having a size of 0.1 μm or greater and a total number of inclusions ($N_{Tot}$) having a size of 0.01-1 μm is 0.5 or greater.

2. The non-oriented electrical steel sheet of claim 1, wherein Al is contained in the amount of 0.3-0.8 wt % therein, and [Mn]<[P], wherein [Mn] and [P] respectively refer to weight percentages of Mn and P.

3. The non-oriented electrical steel sheet of claim 2, wherein the impurities unavoidably added may include at least one selected from Cu, Ni, Cr, Zr, Mo, and V, and Cu, Ni, and Cr are respectively added in an amount of 0.05 wt % or less, while Zr, Mo, and V are respectively added in an amount of 0.01 wt % or less.

4. The non-oriented electrical steel sheet of claim 1, wherein the average size of all inclusions within the steel sheet, which have a size of 0.01-1 μm and include sulfides, is 0.11 μm or greater.

5. The non-oriented electrical steel sheet of claim 1, wherein the size of grains within the microstructures of the electrical steel sheet is 50-180 μm.

* * * * *